United States Patent [19]

Hutchison

[11] Patent Number: 4,623,866

[45] Date of Patent: Nov. 18, 1986

[54] CAP AND BRACKET ASSEMBLY FOR THERMOSTATIC SWITCH AND METHOD OF MANUFACTURING SAME

[75] Inventor: Samuel A. Hutchison, Warren, R.I.

[73] Assignee: Elmwood Sensors, Inc., Pawtucket, R.I.

[21] Appl. No.: 751,372

[22] Filed: Jul. 2, 1985

[51] Int. Cl.[4] ..... H01H 37/04; H01H 45/02

[52] U.S. Cl. ..... 337/380; 337/112

[58] Field of Search ..... 337/380, 112, 113, 381, 337/372

[56] References Cited

U.S. PATENT DOCUMENTS

| | | | |
|---|---|---|---|
| 544,363 | 8/1895 | Martin | 337/380 |
| 2,907,851 | 10/1959 | Moorhead et al. | 337/380 |
| 3,157,768 | 11/1964 | Ladd et al. | 337/380 |
| 3,297,845 | 1/1967 | Mertler | 337/380 |

*Primary Examiner*—Harold Broome

*Attorney, Agent, or Firm*—Salter & Michaelson

[57] ABSTRACT

A cap and bracket assembly for a bimetallic disc actuated thermostatic switch comprises a metallic heat transfer bracket having an aperture therethrough and a metallic cup-shaped cap which is receivable on the housing or body of a thermostatic switch for containing a bimetallic disc. The cap comprises a main portion and a reduced terminal end portion, and the end portion is received in the aperture in the bracket and crimped or swaged to capture the bracket in intimate engagement between the main portion and terminal end portion so that maximum thermal transfer between the cap and the bracket is assured. The method of manufacturing the cap and bracket assembly comprises the steps of assembling the cap with the bracket and crimping or swaging the end portion of the cap to secure the bracket thereto.

8 Claims, 5 Drawing Figures

CAP AND BRACKET ASSEMBLY FOR THERMOSTATIC SWITCH AND METHOD OF MANUFACTURING SAME

BACKGROUND AND SUMMARY OF THE INVENTION

The instant invention relates to thermostatic switching devices and more particularly to a cap and bracket assembly for a thermostatic switch and to a method of manufacturing the cap and bracket assembly.

The use of thermostatic switching devices, of the type comprising a housing having a cap portion and a bimetallic actuating disc received in the cap portion, is extremely well known for a wide variety of temperature related switching applications. It is also well known that for many temperature related switching applications, such as in fire alarm systems, the response times of bimetallic disc actuated thermostatic switches must be minimized in order for the systems in which they are applied to effectively perform their intended functions. Further, it is generally known that the response times of bimetallic disc actuated switches can be significantly reduced if they include heat transfer brackets attached to the caps thereof for collecting and/or transferring heat to bimetallic discs thereof which are received in the caps. In most cases, the brackets of switches of this type are assembled with the caps thereof before the caps are assembled with the other components of the switches and they comprise plate or disc-like elements having apertures therethrough. The caps of cap and bracket assemblies of this type are generally of cup-shaped configuration, and they comprise enlarged substantially circular main portions which define the open ends thereof and reduced substantially circular end portions which define the closed ends thereof. Further, the caps of cap and bracket assemblies of this type are preferably dimensioned and configured so that when they are received in assembled relation with their respective brackets, the end portions thereof are received in snugly fitting relation in the apertures in their respective brackets and the brackets are positioned adjacent the main portions of their respective caps. Further, the caps of cap and brackets assemblies of this type are generally secured together in assembled relation by welding. For use of a thermostatic switching device comprising a cap and bracket assembly of this type, the switching device is mounted so that the bracket thereof is disposed in thermal communication with other elements and/or the air in the surrounding area. Accordingly, when a temperature change occurs in the other elements and/or the air in the surrounding area with which the bracket is in thermal communication, a corresponding temperature change is produced in the bracket, and this temperature change is transmitted to the bimetallic disc of the switching device through the cap portion of the cap and bracket assembly. Hence, the bracket of a device of this type is operative for significantly reducing the response time of the device by providing enhanced thermal communication between the bimetallic disc of the device and other elements and/or the air in the surrounding area.

While the use of heat transfer brackets of the above described type has proven to be an effective means of reducing the response times of thermostatic switching devices, it has also been found that cap and bracket assemblies of the above described type are relatively expensive to manufacture and that in many instances even further reductions in the response times of thermostatic switching devices would be desirable. In this regard, heretofore it has generally been standard practice to secure the cap and bracket portions of assemblies of the above described type together by either resistance welding or ultrasonic welding. However, it has been found that the cap and bracket portions of assemblies of this type can only be effectively secured together by resistance welding when they are made of certain materials, such as stainless steel, and that often the use of these materials, particularly stainless steel, substantially increases the material costs of assemblies of this type. On the other hand, when the cap and bracket portions of assemblies of this type are made of aluminum, which has superior heat transfer qualities, they can only be effectively welded by ultrasonic welding. However, since ultrasonic welding is a comparatively expensive process, this also substantially increases the costs of cap and bracket assemblies of this type. Further, when the cap and bracket portions of assemblies of this tpe are welded together by ultrasonic welding, irregularities are often produced on the interior surfaces of the caps whereon bimetallic discs are supported when the cap and bracket assemblies are assembled in thermostatic switches. Unfortunately, it has been found that surface irregularities of this type can cause frictional resistance to the snap action or flexing movement of bimetallic discs and that this can significantly reduce the repeatability of switches. Finally, it has been found that when the cap and bracket portions of assemblies of this type are secured together by resistance welding or ultrasonic welding, they only contact one another at certain specific points, and this limits the heat transfer therebetween.

The instant invention provides an improved cap and bracket assembly for a thermostatic switch and a method of manufacturing same which overcome many of the disadvantages of the heretofore known cap and bracket assemblies and manufacturing methods. The cap and bracket assembly of the instant invention comprises a metallic cup-shaped cap having a substantially circular main portion and a substantially circular end portion and a metal bracket having an aperture therethrough which is received on the cap. More specifically, the bracket is assembled with the cup-shaped cap so that the reduced end portion of the cap is received in the aperture in the bracket and the end portion of the cap is crimped to capture the bracket in intimate engagement between the main portion of the cap and the end portion. The end portion of the cap preferably comprises a terminal end wall and an end portion side wall which extends from the main portion to the terminal end wall, and the end portion side wall is preferably dimensioned so that the extent thereof from the main portion to the end portion terminal end wall is at least three times the thickness of the bracket, or at least three times the thickness of that portion of the bracket which is adjacent the cap. Further, while the cap is constructed so that it has a certain amount of overall structural rigidity, the end portion of the cap is preferably formed so that the metal thickness thereof is at least thirty percent less than the metal thickness of the main portion of the cap to provide enhanced thermal communication between the bracket and a bimetallic disc received in the cap. The terminal end wall of the cap is preferably formed in a substantially flat configuration, and the main portion of the cap preferably comprises a main portion side wall and an intermediate end wall which extends inwardly from the main portion side wall to the end portion of the cap. When the cap is constructed in this manner, it is preferably assembled in the cap and bracket assembly so that the bracket is captured in intimate engagement between the intermediate end wall of the main portion and the terminal end wall of the end portion to provide uniform metal-to-metal contact between the cap and the bracket around the entire periphery of the cap.

The method of manufacturing a cap and bracket assembly in accordance with the instant invention comprises the steps of assembling a substantially circular metallic cap of the above described type with a bracket of the above described type so that the end portion of the cap is received in the aperture in the bracket, and crimping the end portion of the cap to capture the bracket in intimate engagement between the main portion of the cap and the end portion thereof. In the preferred form of the method, this step is carried out by axially compressing the end portion so that the bracket is captured in intimate engagement between the terminal end wall of the end portion and the intermediate end wall of the main portion and so that a substantially flat circular ring is provided in the interior of the cap for supporting a bimetallic disc thereon.

It is seen that the cap and bracket assembly of the instant invention and the method of manufacturing the cap and bracket assembly represent significant advancements over the heretofore available assemblies and manufacturing methods. Specifically, because the bracket is secured to the cap of the assembly by crimping the end portion of the cap to capture the bracket, intimate metal-to-metal contact between the cap and the bracket around the entire periphery of the cap is virtually assured so that enhanced thermal communication is provided between the bracket and a bimetallic disc received in the cap. Further, since the cap of the assembly is preferably formed so that the end portion thereof has a reduced wall thickness, thermal communication between the bracket and a bimetallic disc contained in the cap is even further enhanced. In addition, since the bracket is secured to the cap by crimping the end portion of the cap, a substantially flat, smooth circular ring is provided in the interior of the cap for supporting a bimetallic disc therein in a manner which permits the disc to flex freely and easily without significant frictional resistance from surface irregularities in the interior of the cap.

Accordingly it is a primary object of the instant invention to provide an improved cap and bracket assembly for a thermostatic switch.

Another object of the instant invention is to provide a cap and bracket assembly for a thermostatic disc wherein the bracket is secured to the cap by crimping the end portion of the cap to provide enhanced thermal communication therebetween.

Another object of the instant invention is to provide an economical method of manufacturing a cap and bracket assembly for a thermostatic switch.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
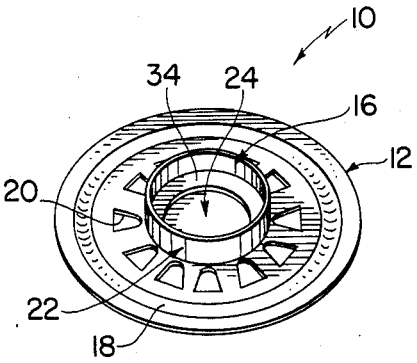
FIG. 1 is a perspective view of the cap and bracket assembly of the instant invention.
Figure 2:
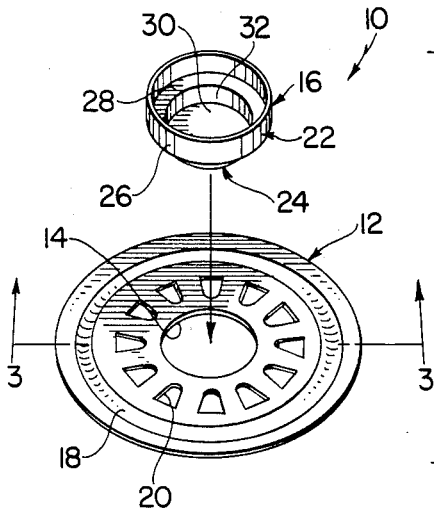
FIG. 2 is an exploded perspective view thereof.

Referring now to the drawing, the cap and bracket assembly of the instant invention is illustrated and generally indicated at 10 in FIGS. 1 through 5. As will be seen, the assembly 10 comprises a substantially circular disc-shaped bracket generally indicated at 12, having an aperture 14 therethrough and a substantially circular cup-shaped cap generally indicated at 16 which is received in the aperture 14 and secured to the bracket 12 by crimping or swaging the end of the cap 16. For use of the assembly 10, it is assembled with other components of a bimetallic disc actuated thermostatic switching device so that the cap 16 is received and secured on an end of the body or housing of the switching device for containing and positioning the bimetallic disc thereof. The switching device is then mounted so that the bracket 12 thereof is disposed in thermal communication with the desired areas and/or elements adjacent thereto, and the switching device is electrically connected to appropriate circuitry for carrying out its intended switching function. Accordingly, when a significant change is realized in the temperature of the areas and/or elements to which the bracket 12 is thermally exposed, the temperature of the bracket 12 is rapidly changed in a corresponding manner, and because the bracket 12 is disposed in intimate metal-to-metal contact with the cap 16, a corresponding change is rapidly realized in the temperature of the bimetallic disc contained in the cap 16. As a result, the bracket 12 is operative for substantially increasing the sensitivity of a thermostatic switching device by substantially reducing the response time thereof.

The bracket 12 preferably comprises a substantially flat metal plate or disc which is made in a stamping operation from a sheet metal, such as aluminum or stainless steel. As herein embodied the bracket 12 comprises a thermal collector which is formed with a circular embossed ring 18 therein for increasing the rigidity thereof, and a plurality of air circulation openings 20 are formed in the bracket 12 for providing enhanced thermal communication between the bracket 12 and the air in the surrounding area. The aperture 14 is preferably disposed in the central portion of the bracket 12, and it is preferably of substantially circular configuration and is dimensioned to receive the cap 16 therein as will hereinafter be more fully set forth.

The cap 16 is preferably formed in a substantially circular cup-shaped configuration, and it has open and closed ends as illustrated. The cap 16 is preferably made of a suitable corrosion-resistant metal, such as aluminum or stainless steel, and it preferably comprises a main portion 22 which defines the open end thereof and a reduced end portion 24 which extends integrally from the main portion 22 and defines the closed end of the cap 16. The main portion 22 preferably has a circumferential main portion side wall 26 and an intermediate end wall 28 which extends inwardly from the side wall 26 to the end portion 24, and the end portion 24 preferably comprises a terminal end wall 30 which defines the closed end of the cap 16 and a circumferential side wall 32 which extends from the main portion 22 to the terminal end wall 30. The cap 16 is preferably dimensioned and configured so that the main portion 22 is of greater dimension than the aperture 14, but so that the end portion 24 is snugly receivable in the aperture 14 and so that the bracket 12 is positionable adjacent the intermediate end wall 28. The cap 16 is preferably formed so that it has sufficient overall structural rigidly to provide an effective means for mounting a bimetallic disc on an end of the body or housing of a thermostatic switch, but is is preferably further formed so that the end portion 24 thereof has a metal thickness which is at least thirty percent (30%) less than the metal thickness in the main portion 22 thereof to provide enhanced thermal conductivity through the end portion 24. Further, the cap 16 is preferably formed so that the extent of the side wall portion 32 thereof from the intermediate end wall 28 to the terminal end wall 30 is at least three times as great as the metal thickness in the portions of the bracket 12 which are adjacent the end portion 24. This assures that there is sufficient material in the end portion 24 to allow it to be crimped to firmly secure the bracket 12 thereto in a manner which will hereinafter be more fully set forth.

Figure 3:
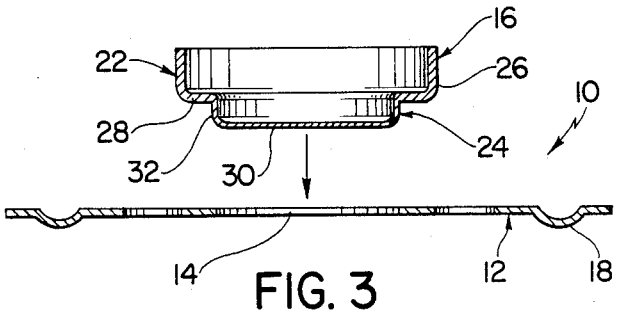
FIG. 3 is an enlarged sectional view taken along line 3—3 of FIG. 2.
Figure 4:
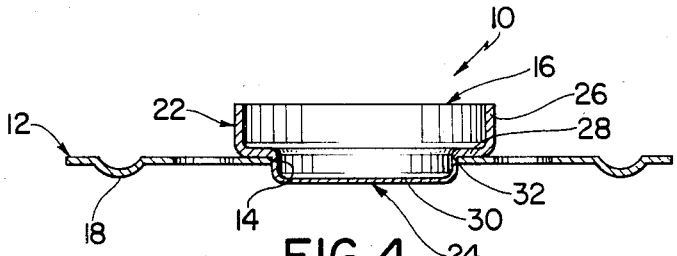
FIG. 4 is a similar sectional view with the cap received in the bracket.
Figure 5:
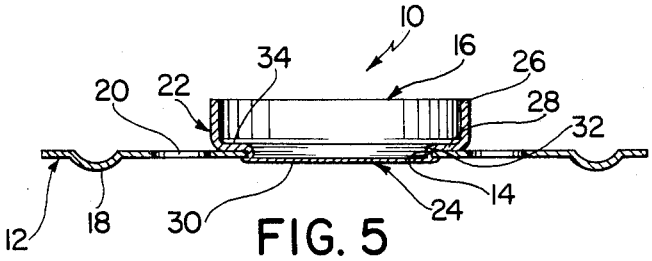
FIG. 5 is a similar view with the cap received in and secured to the bracket.

Referring now to FIGS. 3 through 5, the method of assembling the cap 16 with the bracket 12 to form the cap and bracket assembly 10 is more clearly illustrated. In this regard, the cap 16 is first assembled with the bracket 12 by inserting the end portion 24 into the aperture 14 so that the intermediate end wall 28 is positioned adjacent the surface of the bracket 12 as illustrated in FIG. 4. Thereafter, the end portion 24 is crimped or swaged to deform it to the position illustrated in FIG. 5, wherein the terminal end wall 30 has a slightly increased diameter and the bracket 12 is captured or compressed in intimate engagement between the terminal end wall 30 and the intermediate end wall 28. This provides an effective means of permanently securing the bracket 12 to the cap 16 so that metal-to-metal contact is provided between the bracket 12 and the cap 16 around the entire periphery of the end portion 24 to maximize the thermal communication therebetween. In this regard, preferably the end portion 24 is crimped or swaged by compressing it between a first die which is applied to the interior surface of the intermediate end wall 28 and a second die which is applied to the exterior surface of the terminal end wall 30 so that the end portion 24 is substantially axially compressed therebetween. When the end portion 24 is crimped in this manner, the configuration of the intermediate end wall 28 remains substantially unchanged so that a substantially flat smooth circular ring 34 is provided in the interior of the cap 16 after it has been crimped for receiving a bimetallic disc thereon in a manner which allows the disc to flex without significant frictional resistance from the ring 34.

It is seen therefore that the instant invention provides an effective cap and bracket assembly for a thermostatic switching device as well as an effective method of manufacturing the cap and bracket assembly. The bracket 12 can be easily and economically assembled with and secured to the cap 16 so that effective thermal communication is provided therebetween. In addition, when the end portion 24 of the cap 16 is crimped to secure the bracket 12 to the cap 16, the substantially flat smooth ring 34 is provided in the interior of the cap 16 to provide an effective supporting surface for a bimetallic disc therein. Further, since the end portion 24 has a reduced metal thickness, further enhanced thermal communication is provided between the bracket 12 and a bimetallic disc contained in the cap 16. Hence, it is seen that for all of these reasons as well as the other resons hereinabove set forth, the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A cap and bracket assembly for a thermostatic switch comprising a metallic cup-shaped cap having a substantially circular main portion which defines an open end of said cap and a substantially circular end portion of reduced diameter which extends from said main portion and defines a closed end of said cap, said end portion comprising a terminal end wall and an end portion side wall which extends from said main portion to said terminal end wall, and a bracket made of a sheet metal and having an aperture therethrough, said end portion being received in said aperture in said bracket and being crimped to capture said bracket in intimate engagement between said main portion and said end portion, the extent of said end portion side wall from said main portion to said end portion terminal end wall being at least three times the thickness of the portion of said bracket which is adjacent said aperture therein.

2. In the cap and bracket assembly of claim 1, the metal thickness of said cap in said end portion being at least thirty percent less than the metal thickness of said cap in said main portion.

3. In the cap and bracket assembly of claim 1, the metal thickness of said cap in said terminal end wall being at least 30 percent less than the metal thickness of said cap in said main portion.

4. In the cap and bracket assembly of claim 1, said terminal end wall being substantially flat.

5. In the cap and bracket assembly of claim 1, said main portion comprising a main portion side wall and a main portion intermediate end wall which extends inwardly from said main portion side wall, said end portion side wall extending from said intermediate end wall.

6. In the cap and bracket assembly of claim 5, said bracket being captured in engagement between said intermediate end wall and said terminal end wall.

7. The cap and bracket assembly of claim 5 in combination with a bimetallic disc received and supported in said cap on said intermediate end wall whereby when said cap and bracket assembly and said bimetallic disc are assembled in a thermostatic switch assembly, said bimetallic disc is operative with improved thermal response characteristics for producing a switching action at a predetermined temperature.

8. In an actuating assembly for a bimetallic disc actuated thermostatic switch of the type including a metallic cup-shaped cap having a substantially circular main portion including a main portion sidewall and a main portion intermediate end wall which extends inwardly from said main portion sidewall and a substantially circular end portion of reduced diameter which extends from said main portion and defines a closed end of said cap, said end portion including a terminal end wall and an end portion sidewall which extends from said main portion to said terminal end wall, a bracket made of a sheet metal and having an aperture therethrough, said end portion being received in said aperture so that said bracket is positioned adjacent to said main portion intermediate end wall; the extent of said end portion sidewall from said main portion to said end portion terminal end wall being of at least three times the thickness of the portion of said bracket which is adjacent said aperture therein, and a bimetallic disc received in said cap so that it is supported on said intermediate end wall for actuating switching components of said switch in response to a predetermined temperature condition, the improvement comprising said end portion being crimped to capture said bracket in intimate engagement between said main portion and said end portion and to thereby effect improved thermal communication between said bracket and said bimetallic disc.

* * * * *